US005216474A

United States Patent [19]

Nakao

[11] Patent Number: 5,216,474

[45] Date of Patent: Jun. 1, 1993

[54] IMASE-FORMING APPARATUS WITH TRAY

[75] Inventor: Masahiko Nakao, Suita, Japan

[73] Assignee: Mita Industrial Co., Ltd., Osaka, Japan

[21] Appl. No.: 788,540

[22] Filed: Nov. 6, 1991

[30] Foreign Application Priority Data

Nov. 17, 1990 [JP] Japan ..... 2-312186
Nov. 26, 1990 [JP] Japan ..... 2-323886

[51] Int. Cl.[5] ..... G03G 21/00

[52] U.S. Cl. ..... 355/319; 271/65; 271/163; 271/301; 355/311; 355/322

[58] Field of Search ..... 271/65, 163, 171, 186, 271/223, 301; 355/309, 311, 319, 321, 322

[56] References Cited

U.S. PATENT DOCUMENTS 3,989,236 11/1976 Komori et al. ..... 271/4
4,538,906 9/1985 Brown ..... 271/301 X
4,734,744 3/1988 Yamamoto ..... 355/209
4,949,134 8/1990 Iwaki et al. ..... 355/317
5,110,113 5/1992 Kanaya ..... 271/163 X

FOREIGN PATENT DOCUMENTS 0378177 7/1990 European Pat. Off. .

*Primary Examiner*—Michael L. Gellner
*Assistant Examiner*—P. J. Stanzione
*Attorney, Agent, or Firm*—Wenderoth, Lind & Ponack

[57] ABSTRACT

A single tray serves both as an intermediate tray, for temporarily stacking paper sheets between copying operations thereon when such paper sheets are copies plural times, and as a paper discharging tray for stacking paper sheets subjected to final copying. The tray is arranged on the upstream side of a paper resupplying device. The tray includes a first paper stacking portion and a second paper stacking portion separable from each other. A paper discharging device is provided with a branching guide arranged at an upstream side of a paper discharging location for branching a paper sheet of maximum size on which an image has been formed toward the tray and positioned so that a leading end of the paper sheet when housed in the tray will not reach a paper resupplying roller of the paper resupplying device.

11 Claims, 9 Drawing Sheets

IMASE-FORMING APPARATUS WITH TRAY

BACKGROUND OF THE INVENTION

1. Field of the Invention

The present invention relates to an image forming apparatus capable of achieving formation of a so-called complex image such as formation of overlapped images on one side of a paper sheet or formation of images on both sides of a paper sheet.

2. Description of the Prior Art

A conventional example of the above described type of image forming apparatus is disclosed in, for example, Japanese Patent Application Laid-Open No. Hei 1-236155. Such image forming apparatus comprises a body provided therein with an intermediate tray, a paper discharging device provided with a plurality of paper discharging locations and paper discharging guides capable of being switched to a posture allowing a paper sheet to pass downstream of the respective paper discharging locations, other than a final downstream paper discharging location, a paper resupplying device arranged at a downstream end side of the discharging device and a paper supplying cassette to be inserted into and extracted from the front side of the body. A paper discharging tray receives and discharges paper sheets on which an appointed image has been formed and is housed in the body.

Such known image forming apparatus of the above described construction enables the overlapped formation of images on one side of a paper sheet and formation of images on both sides of the paper sheet. The paper supplying cassette for supplying the paper sheets on which an image is to be formed, and the paper discharging tray for discharging the paper sheets on which one image has been formed are housed in the apparatus. Such structure has the advantage that the apparatus body does not have projections extending therefrom, whereby a space required for installing the apparatus can be reduced.

However, in the above described known image forming apparatus, the intermediate tray and the paper discharging tray are separately spaced vertically. Thus, the disadvantage has occurred that the construction for installation of such members is complicated and requires that the space within the apparatus body be increased, thus increasing the height of the body.

SUMMARY OF THE INVENTION

The present invention has been developed with the above factors in mind, and it is an object of the present invention to provide an image forming apparatus having simplified construction within a body thereof and having a reduced height compared with the known apparatus, such that the apparatus as a whole can be made more compact.

In order to achieve the above described object, according to the present invention an image forming apparatus comprises an apparatus body, a paper supplying cassette which can be inserted into and extracted from the body, a tray for stacking paper sheets on which an image has been formed, a paper discharging device provided with a plurality of paper discharging areas for discharging paper sheets to the tray and a paper resupplying device arranged on the downstream side of the paper discharging device for resupplying paper sheets stacked in the tray. A single tray serves both as an intermediate tray for temporarily stacking paper sheets between copying operations when such paper sheets are copies plural times and a paper discharging tray for stacking paper sheets subjected to final copying. Such single tray is arranged on the upstream side of paper resupplying device. Such tray includes a first paper stacking portion and a second paper stacking portion. A branching guide is arranged at a position such that a paper sheet of maximum size guided toward the tray and housed within the tray does not reach a paper resupplying means in the paper resupplying device. Such means is located such that a leading end of a paper sheet of maximum size on which an image is to be formed reaches such means when supplies to the tray.

According to the above described construction, in the case where a complex image is formed, that is images are overlappedly formed on one side of the paper sheet or images are formed on both sides of the paper sheet, the paper sheet housed to be resupplied is supported on the tray such that it arrives at the paper resupplying means in the paper resupplying device in the same manner as in a conventional image forming apparatus of this type. In such case, the tray serves as the intermediate tray according to the prior art. A paper sheet on which a complex image has been formed, or a paper sheet for use in normal, non-complex image formation, is discharged to the tray through the branching guide such paper sheet is positioned within the tray under such that it does not reach the paper resupplying means, even when such paper is of the maximum size. In this case, the tray serves as a paper discharging tray according to the prior art.

DESCRIPTION OF THE PREFERRED EMBODIMENTS

Figure 2:
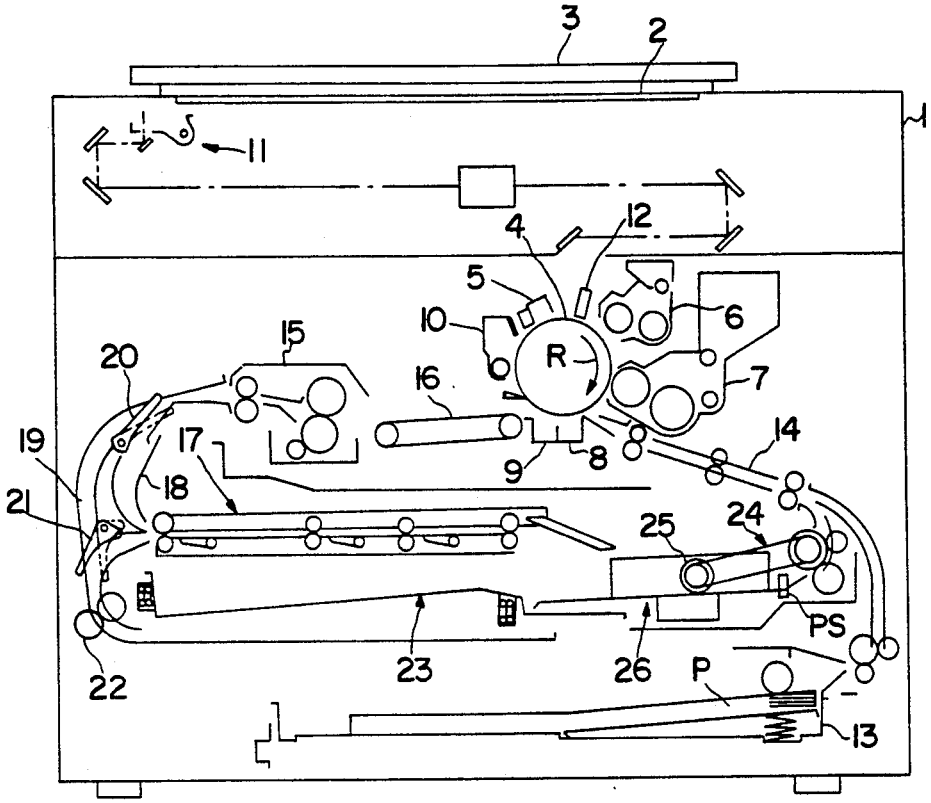
FIG. 2 is a schematic longitudinally sectioned side view showing an electrostatic photographic copying machine as one example of the image forming apparatus.
Figure 3:
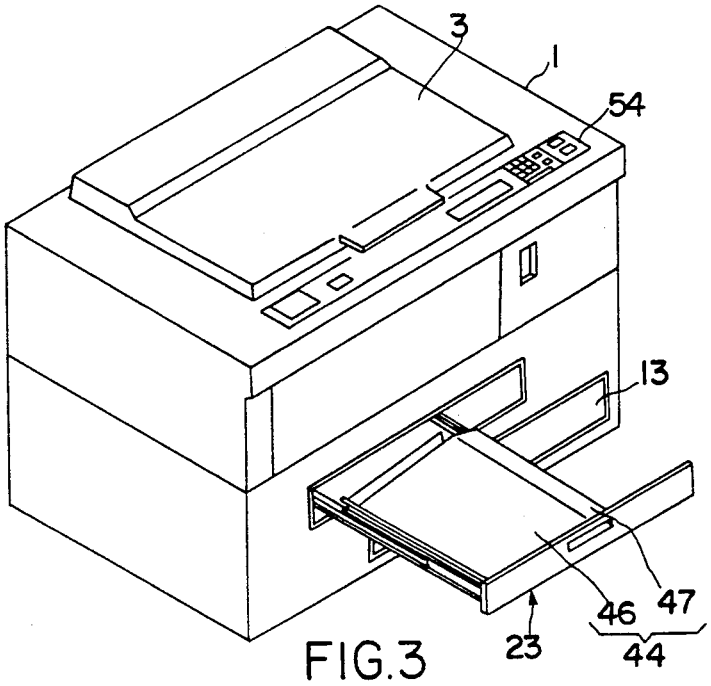
FIG. 3 is a perspective view of the electrostatic photographic copying machine.

FIGS. 2, 3 shows an electrostatic photographic copying machine as one example of an image forming apparatus according to the present invention. Referring to FIGS. 2, 3, reference numeral 1 designates a copying machine body provided with a manuscript carrying table 2 and a manuscript weight 3 on an upper surface portion thereof. Copying machine body has provided therein a drum photoreceptor 4 rotating in the direction of an arrow R in FIG. 2, a charging device 5, developing devices 6, 7, a transfer device 8, a paper separating device 9, a cleaning device 10 and the like arranged at appointed positions around photoreceptor 4 in the order described along rotating direction R and an optical system movement type exposing device 11 arranged in a space thereabove. Reference numeral 12 designates a de-electrifying or charge eliminating device. In addition, the copying machine body 1 has provided therein a supplied paper conveying device 14 for conveying a paper sheet P housed in a cassette 13 adapted to be inserted and extracted from a front side of body 1 toward transfer device 8 and a discharged paper conveying device 16 for conveying a separated paper sheet P toward a fixing device 15.

A main passage or course 18 for guiding a fixed paper sheet P toward a paper discharging device 17 and a switching back passage or course 19 for guiding a fixed paper sheet P in an inverted orientation toward the paper discharging device 17 are arranged downstream of fixing device 15. Reference numeral 20 designates a first course switching member provided at a branch or junction of courses 18, 19. Reference numerals 21, 22 respectively designate a second course switching member and a pair of conveying rollers provided in switch back course 19.

Reference numeral 23 designates a tray provided below paper discharging device 17 for receiving a paper sheet P discharged from the paper discharging device 17 and to house it at an appointed position. Reference numeral 24 designates a paper resupplying device provided on the downstream side of tray 23 for resupplying a paper sheet P having formed on one side thereof an image and wherein a complex image is to be formed, that is wherein manuscript images are to be overlappedly formed on such side, or wherein an image is to be formed on the opposite side, to supplied paper conveying device 14 at an appointed timing. Reference numeral 25 designates paper resupplying rollers. Reference numeral 26 designates a width maintaining mechanism for maintaining paper sheets P stacked on the tray 23 in a uniform width. PS designates a paper stop.

Constructions of the paper discharging device 17 and the tray 23 will be described below with reference to FIG. 1 and FIGS. 4 to 9. Paper discharging device 17 is provided with three pairs of paper discharging rollers 27, 28, 29, each pair including an upper roller and a lower roller mounted on a pair of frames, i.e. an upper frame and a lower frame (not shown). The pairs of rollers are spaced at suitable intervals along device 17. Paper guiding members 30 and 31 are arranged between the paper discharging rollers 27, 28 and 28, 29. Paper discharging areas or locations 32, 33 are located immediately downstream of the upstream pair of paper discharging rollers 27 and the midway pair of paper discharging rollers 28, respectively. Paper discharging guides 34, 35 are pivotably mounted immediately downstream of paper discharging locations 32, 33, respectively. A guide member 37 is located downstream of a paper discharging area or location 36 immediately downstream of the downstream pair of paper discharging rollers 29, for guiding a paper sheet P downwardly. Paper discharging guides 34, 45 selectively are changeable or pivotable to respective paper discharging postures for discharging a paper sheet P into the tray 23, by intersecting a paper discharging path through device 17, and respective postures removed from such paper discharging path to enable a paper sheet P to pass therethrough in a downstream direction.

Figure 4:
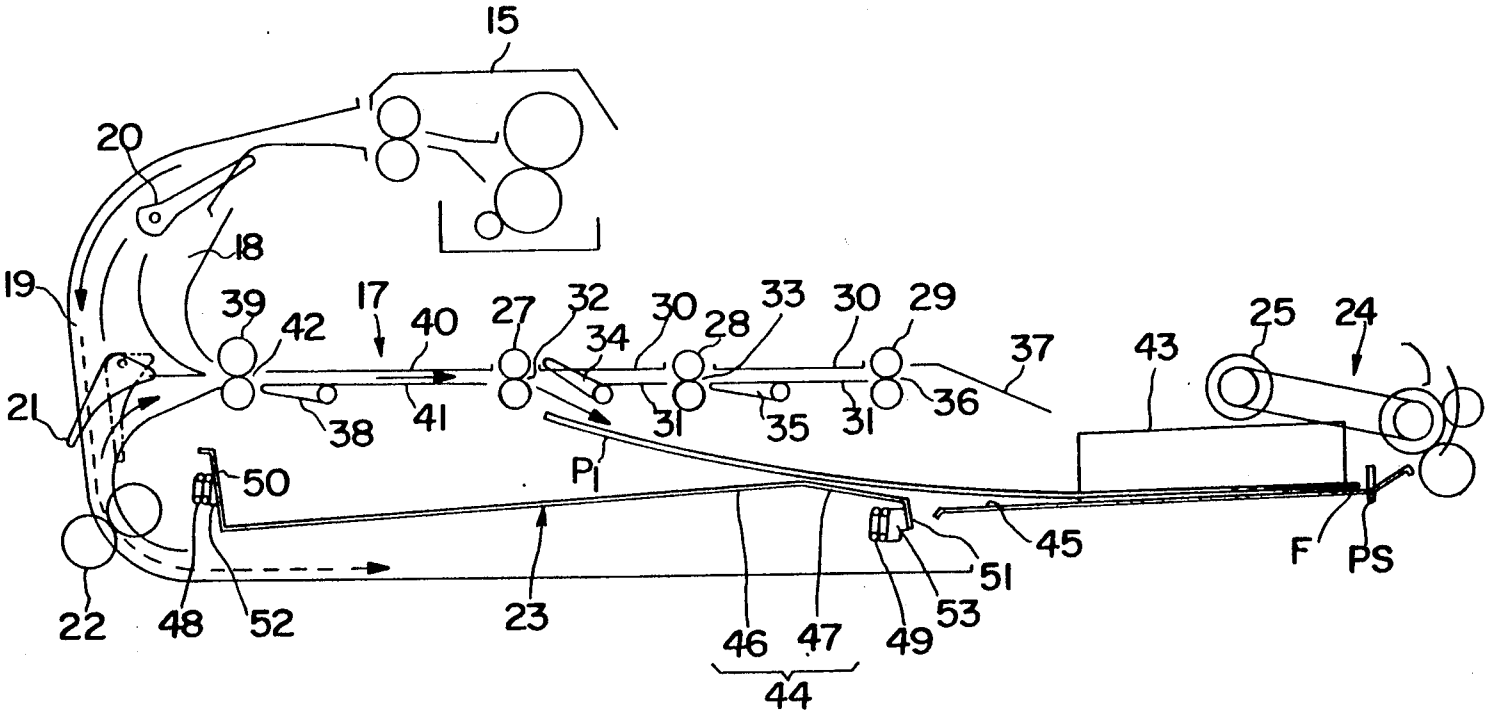
FIGS. 4 to 6 are views similar to FIG. 1 illustrating various states of a paper to be resupplied.
Figure 5:
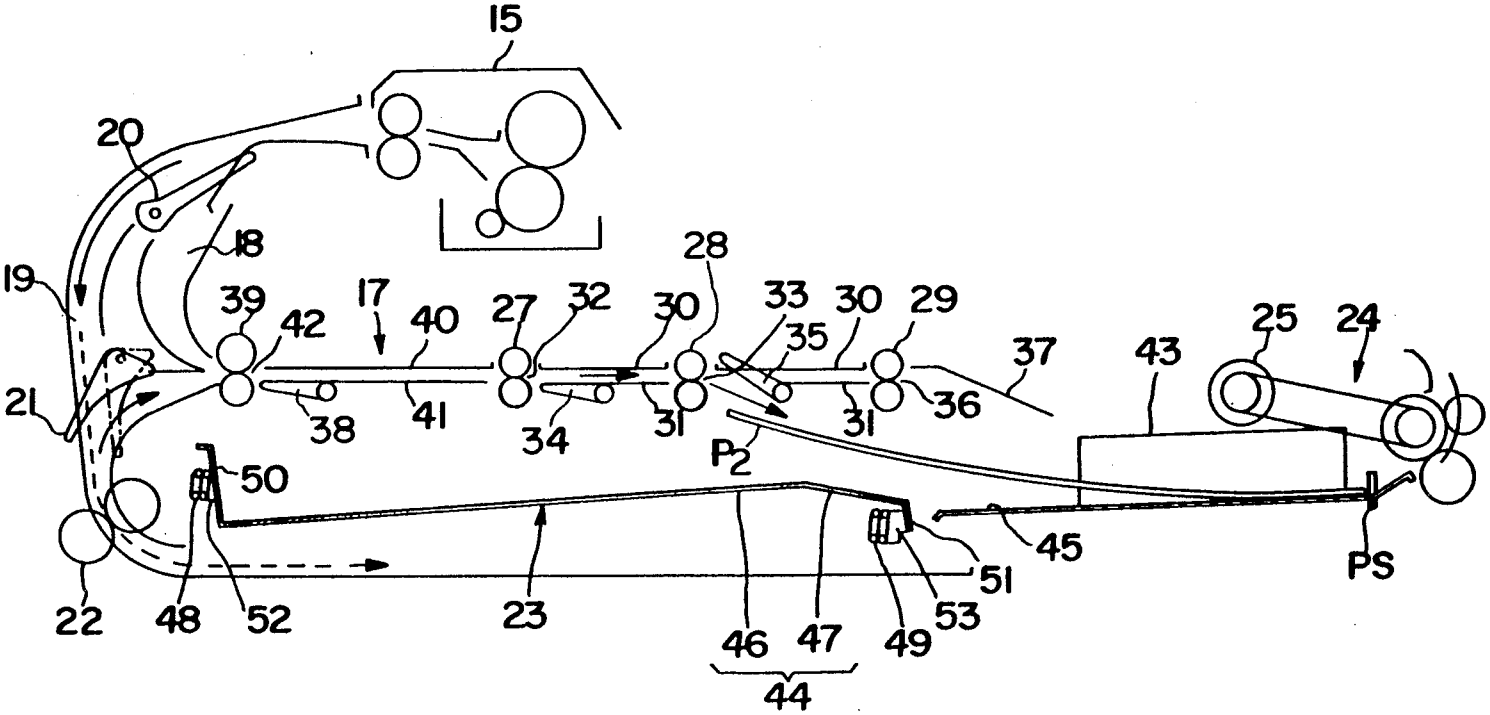
Figure 6:
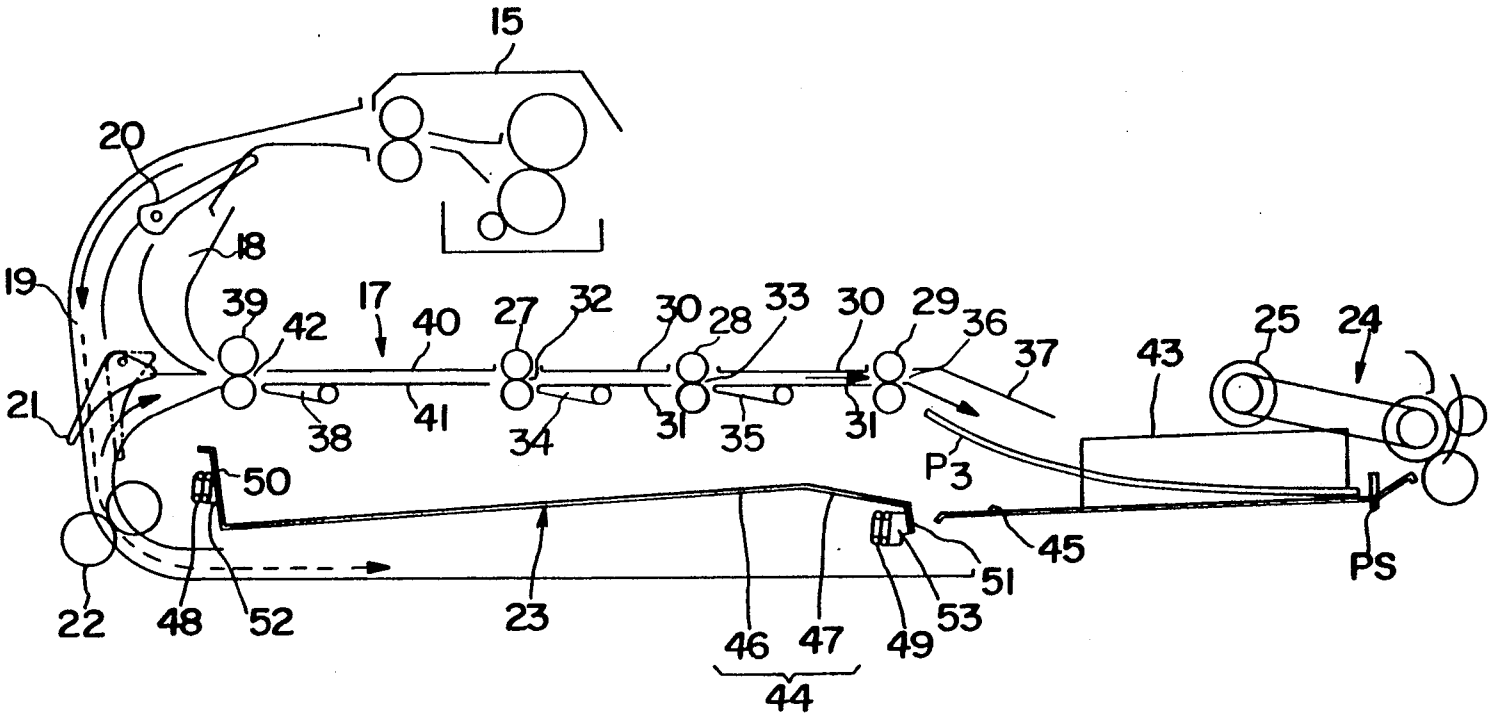

A large size paper sheet $P_1$ having a relatively large length in the conveying direction is guided toward the tray 23 by moving discharging guide 34 on the immediate downstream side of the upstream pair of rollers 27 to the discharging posture or position, as shown in FIG. 4. A middle size paper sheet $P_2$ is guided toward the tray 23 by moving guide 34 to the passing position and by moving paper discharging guide 35 on the immediate downstream side of the midway pair of paper discharging rollers 28 to the discharging posture or position, as shown in FIG. 5. In addition, a small size paper sheet $P_3$ is guided toward the tray 23 by moving both paper discharging guides 34, 35 to the passing positions thereof, thus enabling such paper sheet to pass through downstream roller pair 29, as shown in FIG. 6. The respective paper sheets $P_1$, $P_2$, $P_3$ thus guided onto the tray 23 through the paper discharging locations 32, 33, 36 are maintained uniform widths in tray 23 by means of width maintaining mechanism 26, regardless of the particular widths thereof, and are housed in tray 23 with leading ends thereof engaged with paper stop PS.

Figure 7:
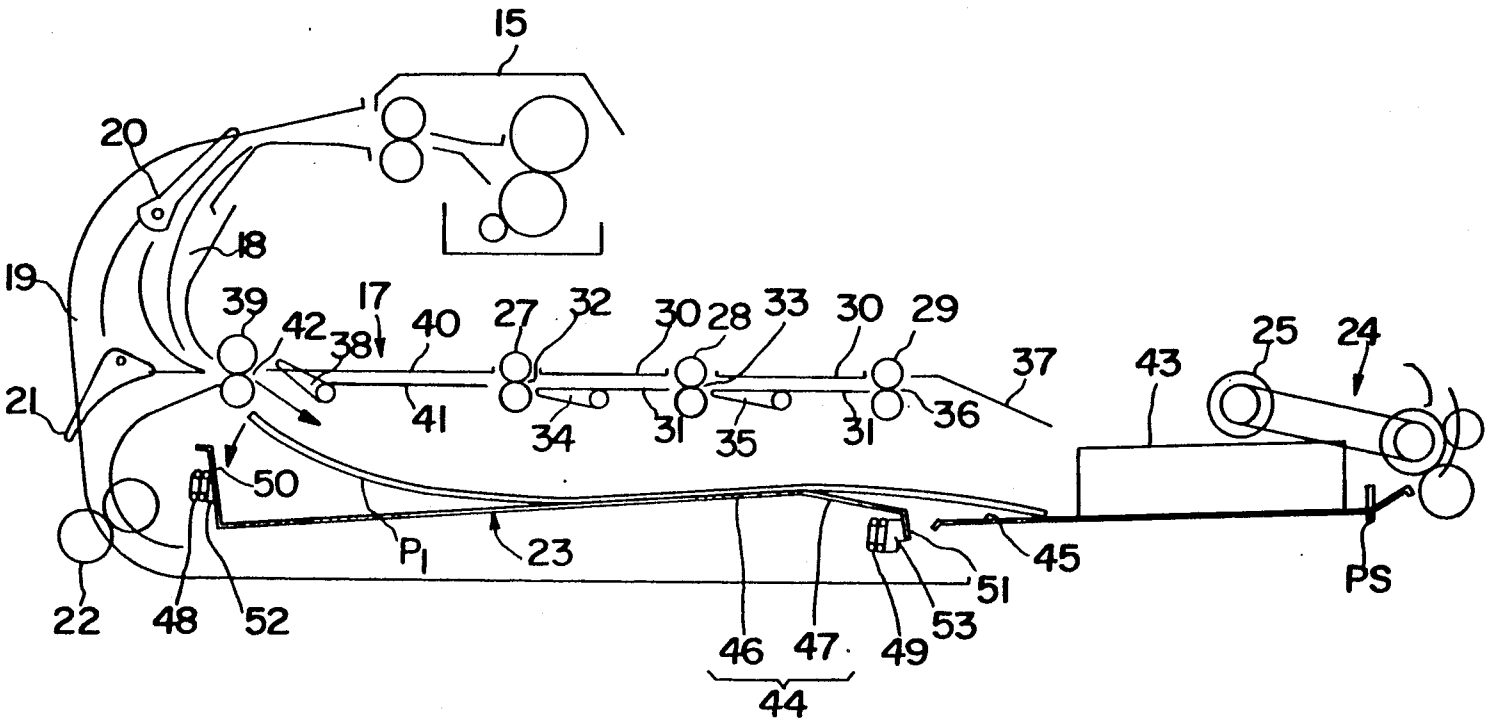
FIGS. 7 to 9 are similar views illustrating various states of a paper subjected to final copying.

A branching guide 38 is provided on the upstream side of the paper discharging location 32 for branching the large size paper sheet $P_1$ toward the tray 23 before location 32. As will be apparent from the following description, guide 38 is used for enabling a temporary stock of paper sheets P to be stacked within the tray 23 midway between copying operations and to enable stacking of paper sheets P subjected to final copying when such paper sheets are subjected to plural copying operations. This is to say, a pair of paper discharging rollers 39 including an upper roller and a lower roller are mounted on the upper frame and the lower frame at a location downstream of a confluence of the course 18 and the course 19. Paper guiding members 40, 41 are arranged between the pair of paper discharging rollers 39 and the pair of paper discharging rollers 27. A paper discharging area or location 42 is located immediately downstream of the pair of paper discharging rollers 39. The branching guide 38 is arranged downstream of paper discharging location 42. The position of the branching guide 38 is such that the leading end of the paper sheet $P_1$ will not arrive at an upstream end portion of a side plate 43 of the width maintaining mechanism 26, when a paper sheet of maximum size (for example the paper sheet $P_1$) on which an image is to be formed is guided toward the tray 23 and housed therein, as shown in FIG. 7. In addition, the paper sheets $P_2$, $P_3$ shorter than the paper sheet $P_1$ may be guided by guide 38 to be housed in the tray 23, as shown respectively in FIG. 8 and FIG. 9.

Furthermore, the tray 23 may be divided into a first paper stacking portion 44 for supporting all paper sheets P subjected to final copying or a part of paper sheets P, including rear ends thereof, to be resupplied, and a second paper stacking portion 45 for supporting leading ends of paper sheets P to be resupplied. That is to say, first portion 44 comprises a first inclined tray portion 46 that is inclined in a manner to have a slightly lower upstream end (the left side in FIG. 1) that is relatively long and that has a relatively large surface area, and a second inclined tray portion 47 that is inclined in a manner to have a lower downstream end, that is relatively short and that has a relatively small surface area. Portion 47 is connected with portion 46. Paper stacking portion 45 is adapted to be separated from second inclined tray portion 47 on the downstream side thereof and is positioned below the side plate 43 of the width maintaining mechanism 26.

Tray guide members 48, 49 extend crossway and in a direction vertical to the paper surface within the body 1. Members to be guided 52, 53 are engaged by tray guide members 48, 49 respectively and are provided on an upstream outer side of a plate 50 on the upstream end of the first inclined tray portion 46 and on an upstream back side of a downwardly bent portion 51 of the second inclined tray portion 47, respectively. By such arrangement, the first portion 44 can be separated from the second portion 45 so that it can be inserted into and extracted from the front side of the body 1.

A paper sheet to be resupplied or a paper sheet subjected to the final copying can be housed in the tray 23 having the above described construction in the following manners.

The paper sheet P to be resupplied is housed so as to extend over the first paper stacking portion 44 and the second paper stacking portion 45, except for a sheet of remarkably small size. that is to say, the large size paper $P_1$ is housed in the tray 23 so that a leading end is engaged with the stop PS and is supported by portions 44 and 45 in the relative manner shown in FIG. 4. A middle size paper sheet $P_2$ and a small size paper sheet $P_3$ are supported on the tray 23 as shown in FIG. 5 and FIG. 6, respectively.

Figure 8:
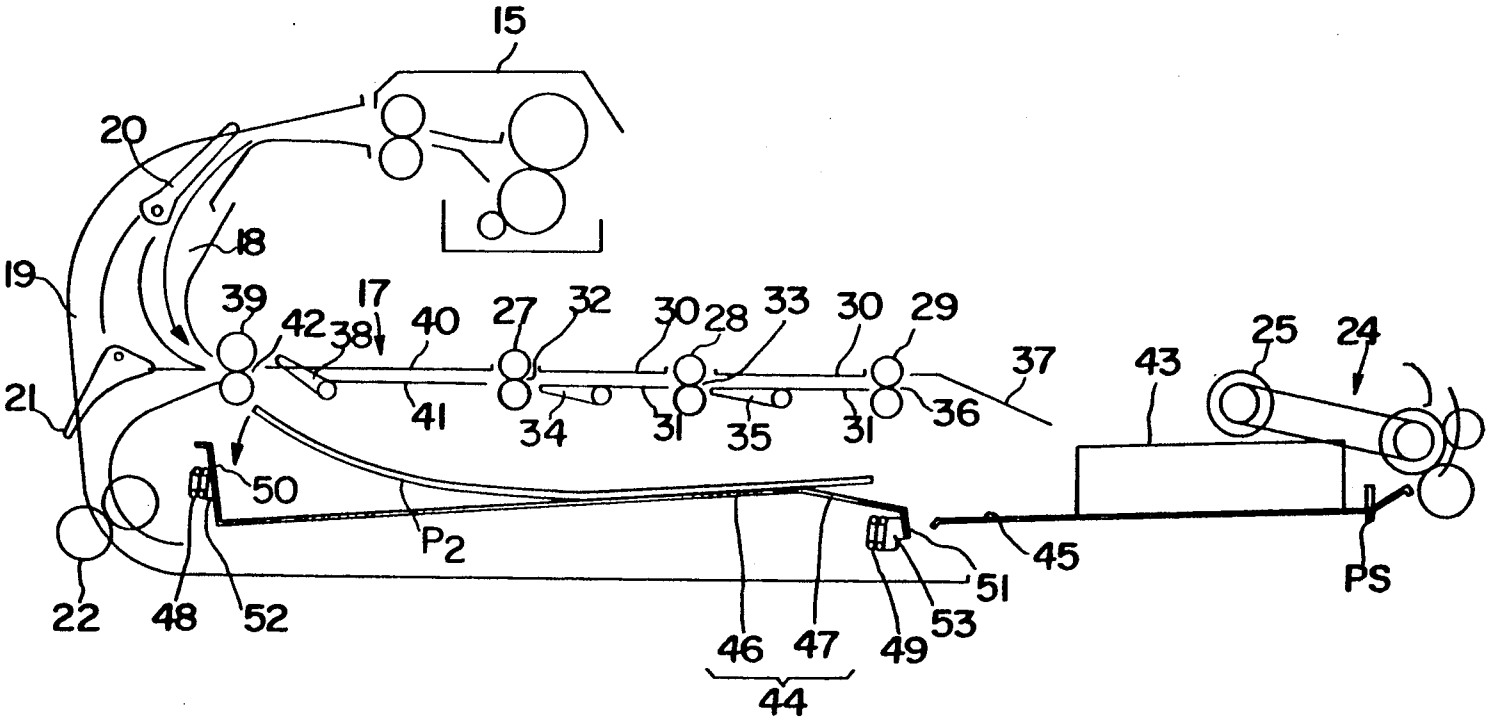
Figure 9:
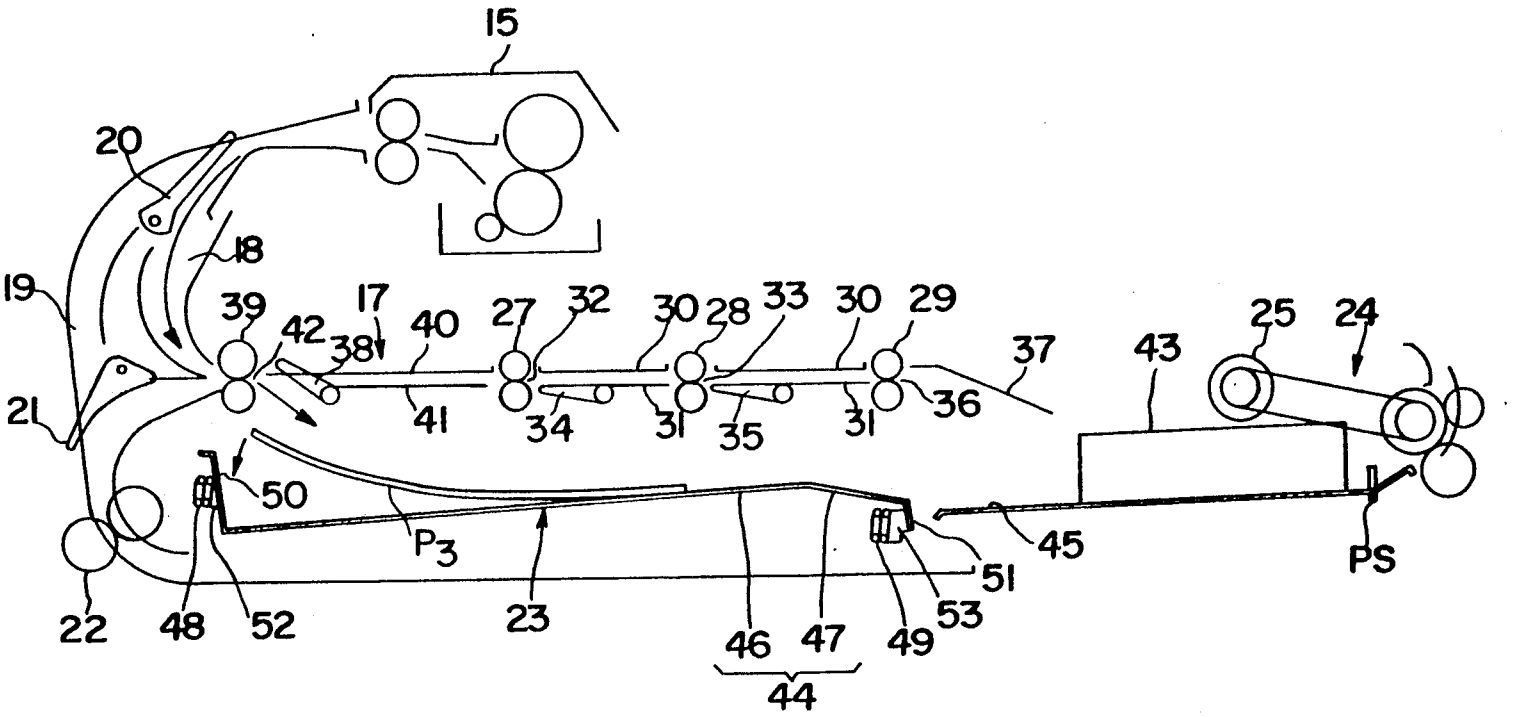

The paper sheet P subjected to final copying is supported substantially only on the first paper stacking portion 44, except for a sheet of relatively large size (for example the paper sheet $P_1$). That is to say, the large size paper sheet $P_1$ is housed in the tray 23 with a trailing end thereof engaged with plate 50 on the upstream end of the first inclined tray portion 46 and with a leading end thereof supported on the second paper stacking portion 45, as shown in FIG. 7. A middle size paper sheet $P_2$ and a small size paper sheet $P_3$ are housed in the tray 23 so as to be supported by the first paper stacking portion 44 as shown in FIG. 8 and FIG. 9, respectively.

Operation of an image forming apparatus having the above described construction now will be described.

Figure 1:
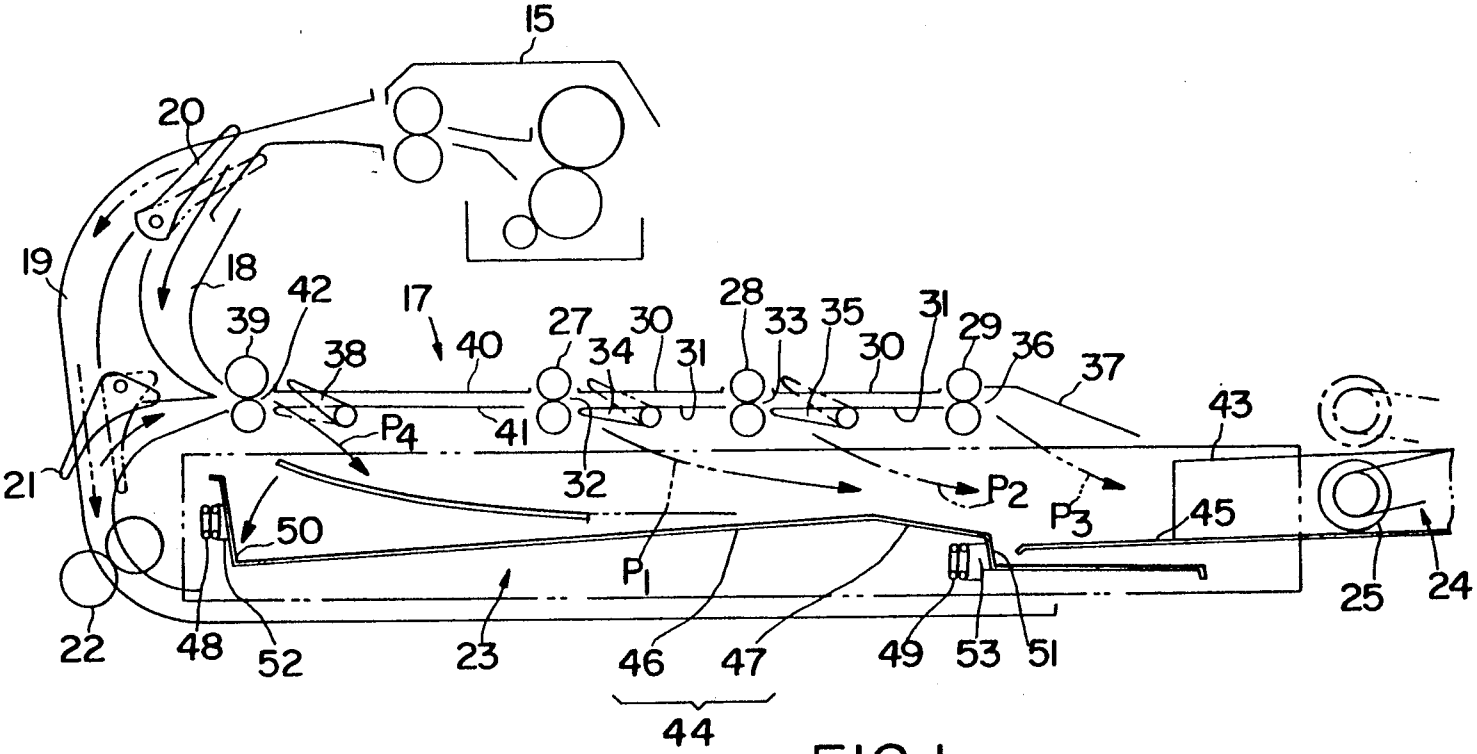
FIG. 1 is a side view showing a construction of principal parts of an image forming apparatus according to the present invention.

Since a manuscript image in most cases usually is formed only one time on one side of a paper sheet P merely one time in the most cases, the branching guide 38 and the first switching member 20 are maintained in the positions shown by full lines in FIG. 1.

A manuscript is placed o manuscript carrying table 2 and covered with manuscript weight 3. Then, upon pushing down a copy key in an operation display portion 54 (refer to FIG. 3) provided on an upper surface of the body 1, exposing device 11 exposes and scans the manuscript and at the same time paper sheets P are supplied toward transfer device 8 from paper supplying cassette 13 in an appointed timing. An electrostatic latent image of the scanned image is formed on the photoreceptor 4 and is transformed into a toner image by developing device 6. Such toner image is transferred onto a paper sheet P by the transfer device 8. Such imaged paper sheet P is sent to fixing device 15 by discharged paper conveying device 16 and is subjected to fixing.

The paper sheet P having thereon such fixed image is guided to the course 18 by the first switching member 20 to arrive at the paper discharging device 17 from which it is transferred to the tray 23 through the paper discharging location 42 by means of the branching guide 38. In such case, the paper sheet is supported on tray portion 46 on the upstream side of the tray 23 with the image facing downwardly. The branching guide 38 is located such that the leading end of a maximum size paper sheet on which copying already has been completed will not reach the paper resupplying rollers 25. That is, the leading end of such paper sheet does not arrive at the paper resupplying rollers 25, even when the paper sheet supplied to the tray 23 through the paper discharging location 42 is not only of small size but also large size (refer to FIGS. 7 to 9).

Upon completion of an appointed number of copies, the paper sheets which have been copies and fixed are stacked on the tray 23. Such copies then can be removed from the apparatus by extracting the tray portion 44 of the tray 2 from the front side of the body 1, as shown in FIG. 3.

In a case where the first switching member 20 and the second switching member 21 are moved to the positions shown by imaginary lines in FIG. 1, the paper sheet P which has fixed thereon an image is delivered to the paper discharging device 17 through the switch back course 19, so that it is housed in device 17 with the image side facing upwardly. The selection of the supply of copied paper with the image thereon facing upwardly or downwardly is achieved by operation of a selection key in operation display portion 54.

In a case where the manuscript image is to be formed overlappingly on one side of the paper sheet, to obtain for example a bi-colored copy, a selection key in the operation display portion 54 for setting such copying mode is operated. In such copying mode, it is required that a paper sheet P which has been subjected to the appointed fixing treatment in the first image formation operation is supported on the tray 23 with the image facing downwardly. Accordingly, the first switching member 20 is maintained in the position shown by solid lines in FIG. 1 and the branching guide 38 is maintained in the position shown by dashed lines in FIG. 1. Paper discharging guides 34, 35 are suitably operated depending upon the size (large, middle, small) of the paper sheet P. For example, assuming that the paper sheet is of large size $P_1$, the paper discharging guide 34 is held in the position shown by solid lines in FIG. 4. When forming the first image, the copy key is operated with the above members held in the positions indicated. The manuscript is exposed to form an electrostatic latent image on the photoreceptor 4 in the same manner as above described but this electrostatic latent image first is developed by the developing device 6. The paper $P_1$, after being subjected to the appointed transfer and fixing treatments, is guided to the course 18 by member 20 and is delivered to the paper discharging device 17, from where it is introduced into the tray 23 through area 32 by means of the paper discharging guide 34. Paper sheet $P_1$ is supported in the tray 23 such that it extends over the second paper stacking portion 45 of the tray 23 and the downstream portion of the first paper stacking portion 44 with the formed image facing downwardly. Paper sheets thus stacked on tray 23 are maintained relative to width by means of the width maintaining mechanism 26, as shown in FIG. 4. After completion of an appointed number of first copying operations, the first switching member 20 and the branching guide 38 are held in the positions shown by solid lines in FIG. 1 and an electrostatic latent image is formed on the photoreceptor 4 in the same manner as in the above described, but this electrostatic latent image is developed by the other developing device 7. The paper sheets $P_1$ are drawn from tray 23 by resupplying device 24 and are subjected to second transfer and fixing treatments. Each such sheet then is guided to the course 18 by means of the first switching member 20 to arrive at the paper discharging device 17 from which it is introduced into the tray 23 through the are 42 by means of the branching guide 38. In this case, the sheet is supported in the tray 23 so as to extend entirely over the first portion 44 and an upstream part of portion 45 of the tray 23 and with the image facing downwardly, as shown in FIG. 7.

When images are to be formed on both sides of the paper sheet, the image forming operations is same as that described above where the image is overlappedly formed on one side of the sheet, except that the paper sheet P which has been subjected to the transfer and fixing treatments on a first side thereof is supplied to the tray 23 with the image facing upwardly. This is achieved by movement of members 20 and 21 to the dashed line positions of FIG. 1, such that the paper sheet moves through course 19. Member 21 then is moved to the solid line position in FIG. 1, and the sheet is delivered by rollers 22 to device 17 with the image facing upwardly.

Figure 10:
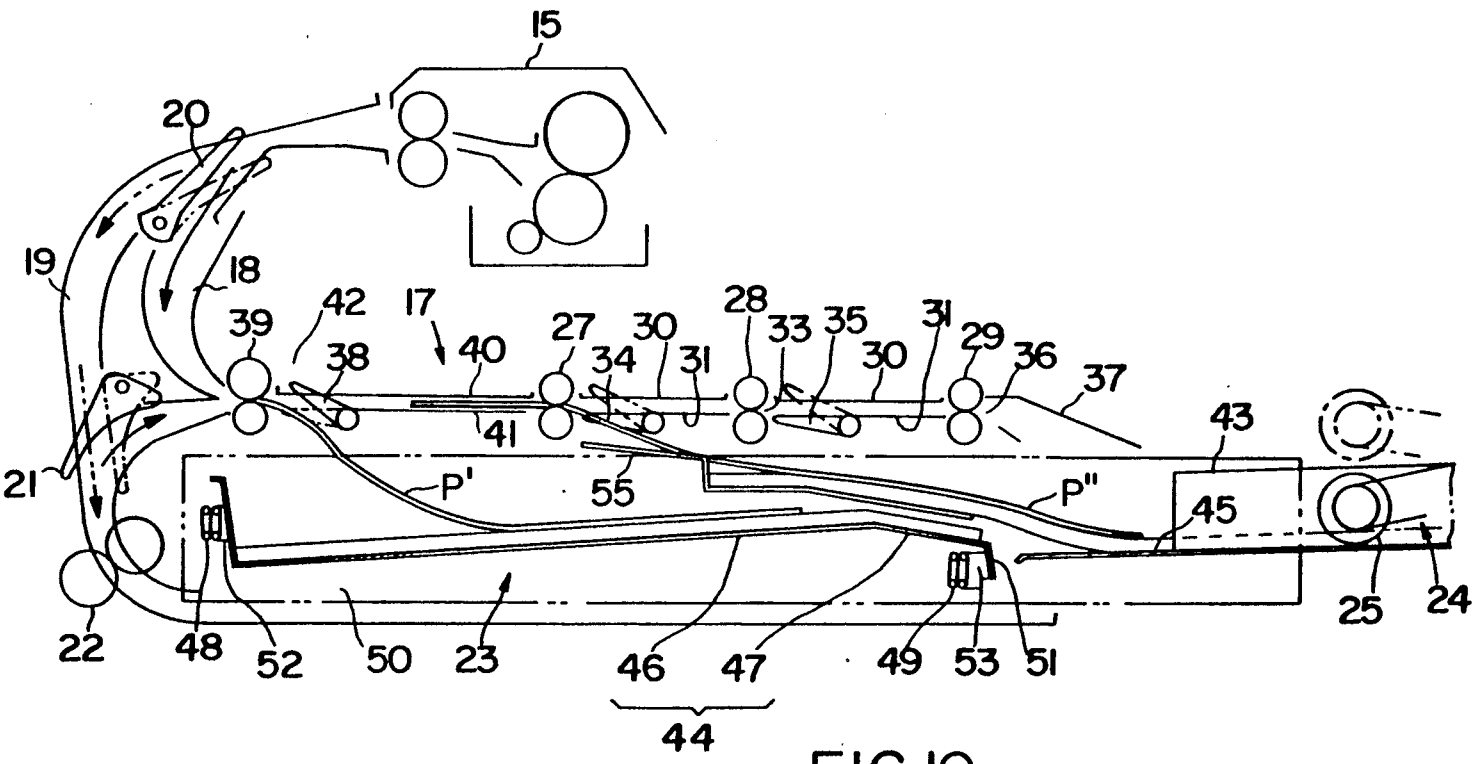
FIG. 10 is a similar view illustrating a state both of the paper to be resupplied and the paper subjected to final copying.

Furthermore, a fixed guide 55 may be provided above the first inclined tray portion 46. In this case, a paper sheet P' which has been subjected to the final copying can be separately positioned beneath a paper sheet P'' to be resupplied, as shown in FIG. 10.

In the image forming apparatus having the above described construction, the copying of modes other than the modes described above is possible, but description thereof is omitted herein.

Also, although the first paper stacking portion 44 is described as being adapted to be inserted into and extracted from the front side of the body in the above preferred embodiment, the second paper stacking portion 45 also may be adapted to be inserted into and extracted from the front side of the body 1.

According to the present invention, there is provided an arrangement whereby a single tray serves not only as an intermediate try for temporarily housing paper sheets, but also as a paper discharging tray for housing paper sheets on which completed images have been formed. Such arrangement is provided in the body of an image forming apparatus body. Thus, a conventionally employed intermediate tray also can be used as a paper discharging tray. Therefore, the structure for tray installation and support can be simplified, extra space in the height direction of the apparatus becomes unnecessary, and the overall image forming apparatus of this type can be made more compact.

According to the present invention, the tray housed in the body of the image forming apparatus body is adapted to be divided into a first paper stacking portion for stacking paper sheets which have been subjected to final copying and a second paper stacking portion for stacking paper sheets to be resupplied. Thus, the first paper stacking portion can be simply extracted from, for example, the front side of the body of the image forming apparatus body without any hindrance to other members of the apparatus, for example paper resupplying rollers, and the paper sheets which have been subjected to final copying simply can be removed. Thus, the tray of the invention is handy and can be used very easily.

Also, according to the present invention it is not necessary to dislocate and specially control a part having many movable portions, such as the paper resupplying means. Therefore, the construction of such part is simplified, so that reliability thereof can be improved and cost thereof can be reduced.

What is claimed is:

1. In an image forming apparatus capable of performing plural copying operations on each of paper sheets of a plurality of sizes and comprising an apparatus body, the improvement wherein said apparatus further comprises:

a single tray positioned within said body and including an upstream first portion and a downstream second portion;

a paper discharging device for receiving selectively either a partially copied paper sheet having formed thereon an image and to be resupplied to have formed thereon another image or a finally copied paper sheet having been subjected to a final copying operation and for discharging selectively the partially copied paper sheet to said tray such that a leading end of the partially copied paper sheet is housed in said downstream second portion of said tray of the finally copied paper sheet to said tray such that a trailing end of the finally copied paper sheet is housed in the upstream first portion of said tray;

said tray having a length dimension between opposite upstream and downstream ends thereof greater than a maximum length of a largest size paper sheet to be copied;

a paper resupplying device located downstream of said tray at a position such that said paper resupplying device will confront the leading end of the partially copied paper sheet, to enable resupplying thereof from said downstream second portion of said tray, but such that said paper resupplying device will be spaced from and not confronting a leading end of the finally copied paper sheet, to prevent resupply thereof from said tray; and said upstream first portion of said tray being separable from said downstream second portion thereof and being mounted on said body for insertion therein and extraction therefrom, thereby enabling finally copied paper sheets to be removed from said apparatus.

2. The improvement claimed in claim 1, wherein said upstream first portion of said tray includes an elongated inclined part having a lowered upstream end.

3. The improvement claimed in claim 1, wherein said upstream first portion of said tray includes an upstream first inclined part having a lowered upstream end and a downstream second inclined part joined to said first inclined part and having a lowered downstream end, said first inclined part having an area greater than that of said second inclined part.

4. The improvement claimed in claim 3, wherein said second inclined part is located upstream of said downstream second portion of said tray and is separable therefrom.

5. The improvement claimed in claim 3, further comprising means for urging said upstream first portion of said tray in a downstream direction toward said downstream second portion of said tray.

6. The improvement claimed in claim 5, wherein said urging means comprises guide members abutting projecting portions of said first and second inclined parts and extending widthwise thereof, and pressing means pressing said guide members in a downstream direction.

7. The improvement claimed in claim 1, wherein said paper discharging device has spaced therealong a plurality of paper discharging guides for discharging to said tray respective sizes of partially copied paper sheets, and a branching guide located upstream of an upstreammost said discharging guide for discharging to said tray finally copies paper sheets.

8. The improvement claimed in claim 7, further comprising a pair of discharge rollers positioned immediately upstream of said branching guide and a pair of guide members positioned downstream of said branching guide for receiving a paper sheet from said pair of discharge rollers and for guiding movement thereof in a downstream direction toward said paper discharging guides, said branching guide comprising a pivotable member mounted to selectively intercept a paper sheet from being passed from said pair of discharge rollers to said pair of guide members and to discharge the thus intercepted paper sheet to said tray.

9. The improvement claimed in claim 8, wherein at least said upstreammost discharge guide comprises a pair of guides, a pair of rollers positioned upstream of said pair of guides for discharging thereto a paper sheet, and a pivoting member mounted to selectively intercept a paper sheet from being passed from said pair of rollers to said pair of guides and to discharge such intercepted paper sheet to said tray.

10. The improvement claimed in claim 8, wherein a downstreammost said discharge guide comprises a fixed deflecting member for discharging a paper sheet to said tray.

11. The improvement claimed in claim 1, further comprising a fixed guide, positioned below said paper discharging device and above said tray, for guiding a partially copied paper sheet to said downstream second portion of said tray when a finally copied paper sheet is supported on said upstream first portion of said tray.

* * * * *